US005600208A

United States Patent [19]

Katou et al.

[11] Patent Number: 5,600,208

[45] Date of Patent: Feb. 4, 1997

[54] DISCHARGE LAMP UNIT HAVING SEPARABLE HIGH-VOLTAGE TRANSFORMER SAFEGUARD

[75] Inventors: Kouichi Katou, Anjou; Koichi Toyama; Kenji Aida, both of Kariya, all of Japan

[73] Assignee: Nippondenso Co., Ltd., Kariya, Japan

[21] Appl. No.: 544,706

[22] Filed: Oct. 18, 1995

[30] Foreign Application Priority Data

Nov. 10, 1994 [JP] Japan ..... 6-276763

[51] Int. Cl.[6] ..... H01J 7/44

[52] U.S. Cl. ..... 315/70; 315/56; 315/57; 315/289

[58] Field of Search ..... 315/70, 56–59, 315/49, 289, 290; 313/51, 52; 361/603; 439/620

[56] References Cited

U.S. PATENT DOCUMENTS

| | | | |
|---|---|---|---|
| 3,815,080 | 6/1974 | Summa | 339/52 R |
| 4,223,247 | 9/1980 | Jacobs et al. | 315/70 X |
| 4,574,219 | 3/1986 | Davenport et al. | 315/49 |
| 4,723,097 | 2/1988 | Heindl et al. | 315/289 |
| 4,998,044 | 3/1991 | Nilsson | 315/70 X |
| 5,122,714 | 6/1992 | Chermin et al. | 315/289 |
| 5,394,062 | 2/1995 | Minarczyk et al. | 315/129 |

FOREIGN PATENT DOCUMENTS

| | | |
|---|---|---|
| 4-293630 | 10/1992 | Japan . |
| 6-119911 | 4/1994 | Japan . |

*Primary Examiner*—Robert Pascal
*Assistant Examiner*—Haissa Philogene
*Attorney, Agent, or Firm*—Cushman, Darby & Cushman IP Group of Pillsbury Madison & Sutro LLP

[57] ABSTRACT

A discharge lamp unit which does not require enlargement of the discharge lamp and can still prevent application of a high voltage to a cap holder when the lamp is not connected includes a core of a high-voltage transformer inside a cap of the discharge lamp. Both a primary coil and a secondary coil of the high-voltage transformer are provided around a cap holder of the discharge lamp power supply. The cap of discharge lamp is inserted into the cap holder of the discharge lamp power supply to provide an electromagnetic link between the primary coil and the secondary coil of the high-voltage transformer.

15 Claims, 4 Drawing Sheets

DISCHARGE LAMP UNIT HAVING SEPARABLE HIGH-VOLTAGE TRANSFORMER SAFEGUARD

CROSS-REFERENCE TO RELATED APPLICATIONS

This application is related to and claims priority from Japanese Patent Application No. Hei. 6-276763, incorporated herein by reference.

BACKGROUND OF THE INVENTION

1. Field of the Invention

This invention relates to a discharge lamp unit which applies a high voltage to a discharge lamp .such as a metal halide lamp at the start of lighting, to light up the lamp.

2. Description of the Related Art

In general, the above-described type of discharge lamp unit generates a high voltage ranging from a few kilovolts to a few tens of kilovolts using a high-voltage generation circuit and applies the generated high voltage to the discharge lamp at the time of lighting, to discharge the lamp instantly. Once the lamp lights up, the discharge lamp unit keeps applying a low voltage of a few tens of volts to the lamp so that the lamp can be kept lit continuously.

Thus, if the unit is started with the discharge lamp having been removed when, for instance, the lamp needs to be replaced by a new one, a high voltage will be applied to the cap holder of the lamp. This has necessitated that the cap holder and its peripheral section withstand such a high voltage. For this purpose, the cap holder and its peripheral section have been enlarged or materials having high voltage withstanding characteristics have been employed, thereby resulting in an increase in costs.

To solve the above problem, a suggestion for a discharge lamp unit having a start and lighting circuit, containing a high voltage circuit below the discharge lamp in the same unit has been made (for instance, refer to U.S. Pat. No. 4,574,219). However, with such a discharge lamp unit, the unit itself becomes larger and the entire unit must be replaced to change a bulb.

In Japanese Patent Laid-Open No. Hei. 6-119911, a discharge lamp unit having only a starting circuit booster transformer in the same unit was introduced. However, with this type of unit, at least four connecting wires and connectors were required in the bottom of the discharge lamp, resulting in increased size of the unit.

Furthermore, in Japanese Patent Laid-Open No. Hei. 4-293630, a discharge lamp unit having a connection detection circuit which detects whether the discharge lamp is connected to the cap and shuts off the high voltage supplied to the cap holder if the cap of the discharge lamp is not connected to the cap holder, to prevent application of high voltage when the lamp is not connected, was introduced. However, a special connection detection circuit and detection wires to connect such a circuit to the cap holder were required, thus making the structure complicated.

SUMMARY OF THE INVENTION

This invention has been made with the above problems in mind, and a purpose of the invention is to provide a discharge lamp unit which does not require enlargement of the discharge lamp and which can prevent application of a high voltage to the cap holder when the lamp is not connected, as well as a discharge lamp and discharge lamp power supply.

In order to solve the above problems, the discharge lamp unit according to this invention consists of a lamp section (i.e., a discharge lamp) and a base section on which the lamp section is mounted. A feature of the discharge lamp unit is that a part of a high-voltage transformer which applies a high voltage to the lamp section at the start of lighting is provided in the lamp section and the remaining part of the high-voltage transformer is provided in the base section.

It is also possible to install the core of the high-voltage transformer in the lamp section and both primary and secondary coils of the transformer in the base section. Moreover, it is also possible to install the core and secondary coil of the transformer in the lamp section and the primary coil of the transformer in the base section.

Furthermore, it is also possible to provide an electromagnetic link between the primary and secondary coils of the high-voltage transformer by installing the core or the core and secondary coil in the cap of the lamp section and the primary and secondary coils or the primary coil on the peripheral surface of the cap holder of the base section so that the cap of the lamp section is inserted into the cap holder of the base section.

With a discharge lamp unit having the above structure, the primary coil and secondary coil of the high-voltage transformer are connected electromagnetically since the cap of the lamp section is inserted into the cap holder of the base section. Thus, if the output voltage from the starting circuit is supplied via the high-voltage transformer to the lamp section with the cap of the lamp section being inserted into the cap holder of the base section, the high voltage can be applied to the flash tube of the discharge lamp via the secondary coil and cap, thus allowing the flash tube to start discharging instantly. Once the lamp lights up, the voltage is supplied from the lighting circuit to the flash tube via the cap, thus keeping the lamp lit continuously.

However, if the cap of the lamp section is disconnected from the cap holder of the base, for instance, to replace the lamp with a new one, the core of the high-voltage transformer will be separated from the primary and secondary coils or the core and secondary coil will be separated from the primary coil, thereby stopping the function of the high-voltage transformer. Thus, even if the output voltage from the starting circuit is supplied to the high-voltage transformer with the lamp section being disconnected, no high voltage will be generated in the secondary coil, i.e., the cap holder of the base section.

Introduction of a part of the high-voltage transformer into the lamp section has resolved the problems discussed above while keeping the size of the lamp section, i.e., the discharge lamp, reasonably small. Furthermore, no high voltage will be applied to the cap holder of the base section when the lamp section is disconnected; thus, it is not necessary to increase the withstanding voltage of the cap holder. Thus, the cap holder can be made even smaller than conventional ones, and it can be made of inexpensive material having a low withstanding voltage.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
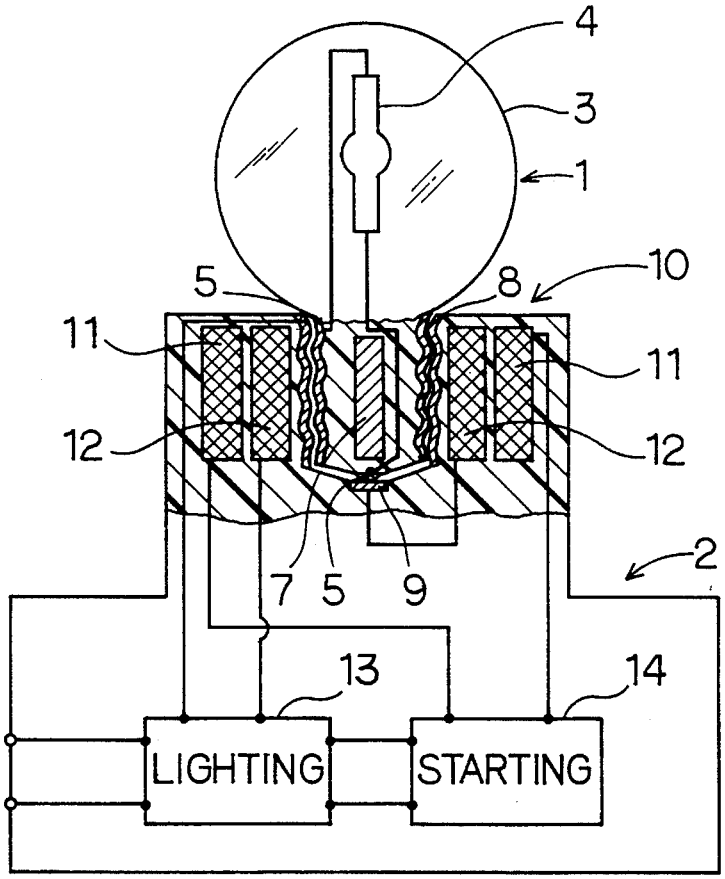
FIG. 1 is a partial cross-sectional view of a discharge lamp unit according to a first embodiment 1 of the present invention.
Figure 2:
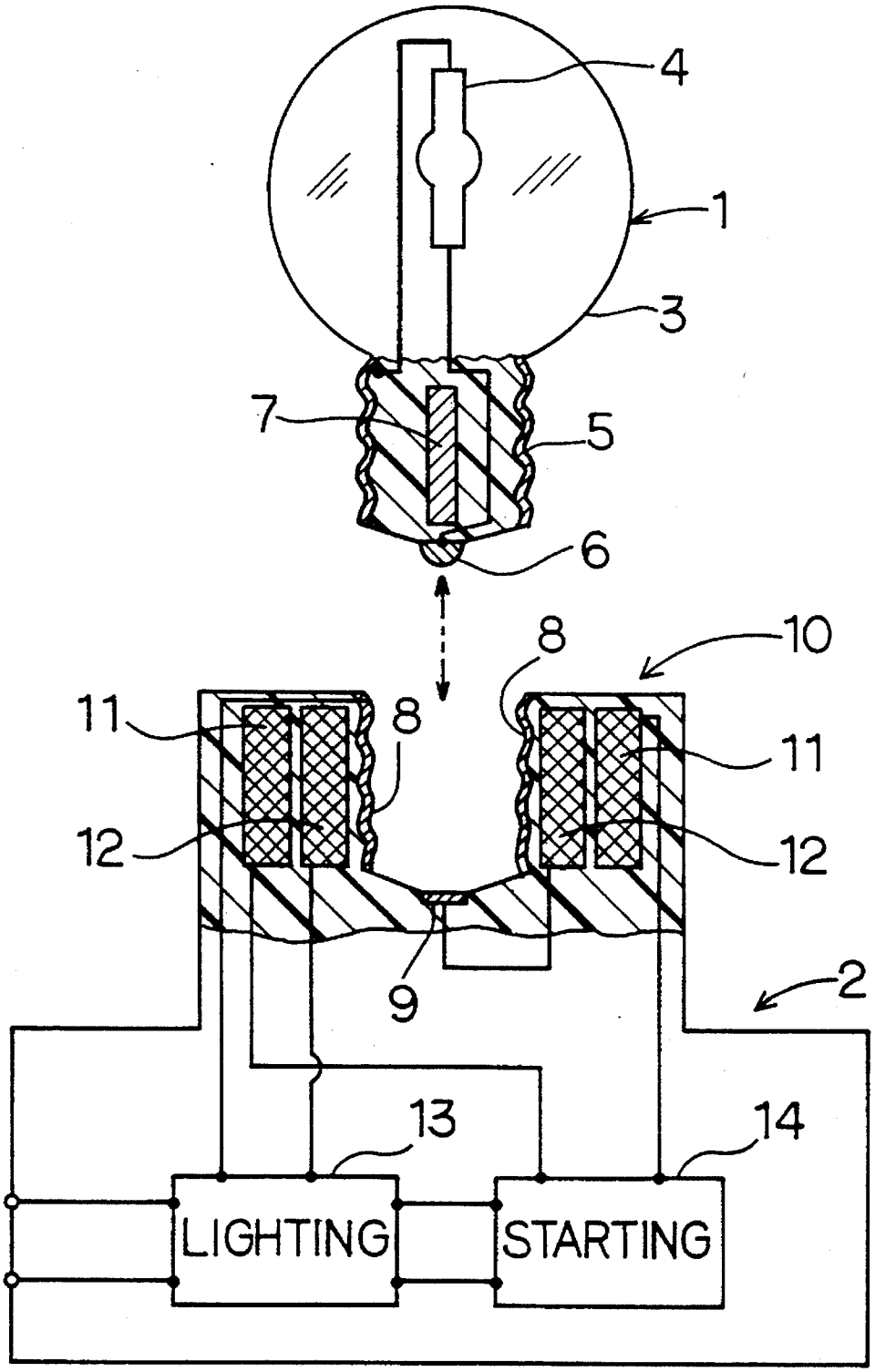
FIG. 2 is a partial cross-sectional view of a discharge lamp unit according to the first embodiment with the discharge lamp disconnected.

FIGS. 1 and 2 are partial cross-sectional views showing a discharge lamp unit according to a first embodiment of the present invention. This discharge lamp unit consists of discharge lamp 1, which forms the lamp section, and a discharge lamp power supply 2, which forms the base section.

Discharge lamp 1 consists of flash tube 4 which is located inside glass external tube 3, cap 5 which is fixed below external tube 3, and insulated terminal 6 which is fixed below cap 5. External tube 3 is filled with inactive gas, and flash tube 4 is filled with mercury and argon, or the like.

Core 7 which forms the core section of high-voltage transformer 10 is fixed in the middle of cap 5 with insulating materials (e.g., synthetic resin, ceramic, glass, etc.). Core 7 is made of magnetic material such as ferrosilicon and ferrite, and its size and shape are determined according to the magnitude of the voltage to be generated. One electrode of flash tube 4 is connected to terminal 6 via a connecting wire, and the other electrode is connected to cap 5.

On top of discharge lamp power supply 2, an insertion section used to mount discharge lamp 1, that is cap holder 8 used to receive cap 5, is provided. Cap holder 8 is made of conductive metal such as bronze and is formed into a cup-like shape. Beneath cap holder 8, insulated receive terminal 9 is fixed so that terminal 6 will come into contact with receive terminal 9 when cap 5 of discharge lamp 1 is fitted to cap holder 8.

Secondary coil 12 of high-voltage transformer 10 is wound around cap holder 8, and primary coil 11 is wound around the periphery of secondary coil 12. Both primary coil 11 and secondary coil 12 consist of the rounds of winding, and they are fixed to the position of the periphery of cap holder 8 using an insulator.

Lighting circuit 13 and starting circuit 14 are provided inside discharge lamp power supply 2. Lighting circuit 13 uses, for instance, a DC/DC converter and a DC/AC converter, to increase the DC voltage supplied from the DC power supply to the appropriate lighting level, convert the voltage to a high-frequency voltage and output it.

Figure 3:
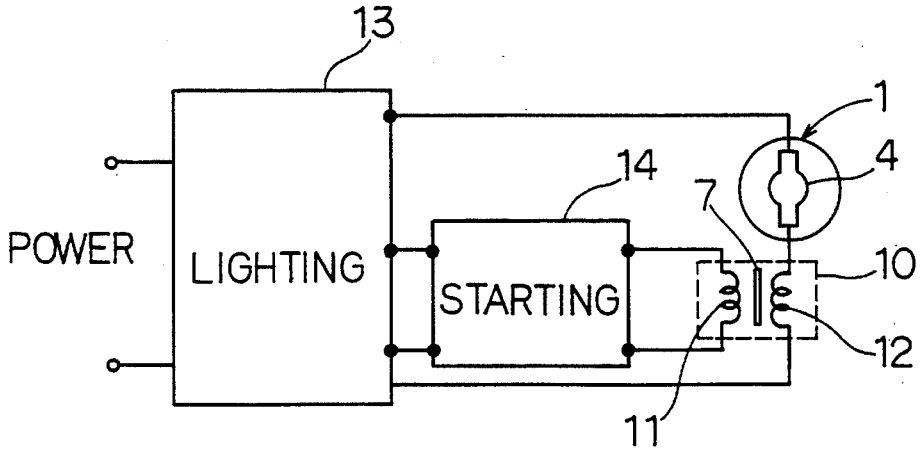
FIG. 3 is a schematic diagram showing connection of the lighting circuit, starting circuit, high-voltage transformer and the like in the first embodiment.

As shown in FIG. 3, starting circuit 14 receives the high-frequency signal from the lighting circuit 13, generates a pulse signal and outputs it to primary coil 11 of high-voltage transformer 10. The output side of lighting circuit 13 is connected to cap holder 8 and secondary coil 12, and the output side of starting circuit 14 is connected to both ends of primary coil 11 of high-voltage transformer 10.

The following is a description of the operation of a discharge lamp unit having the above structure.

As shown in FIG. 1, discharge lamp 1 is fitted in place as its cap 5 is inserted into cap holder 8 located on top of power supply 2. This provides an electrical connection between cap 5 and cap holder 8 and between terminal 6 and receive terminal 9. Furthermore, core 7 is located at the center of both primary and secondary coils 11 and 12 of high-voltage transformer 10 to provide an electromagnetic link for both coils 11 and 12.

When lighting circuit 13 and starting circuit 14 begin to operate as the power switch, which is not shown in the figure, is turned on, starting circuit 14 outputs a high-frequency pulse signal to primary coil 11 of high-voltage transformer 10, according to the high-frequency signal sent from lighting circuit 13. As a result, secondary coil 12 of high-voltage transformer 10 generates a high-frequency, high-voltage pulse, which is then sent to flash tube 4 of discharge lamp 1 via terminal 6 and cap 5, commencing discharge inside flash tube 4 to light up discharge lamp 1 instantly.

Once discharge has started, starting circuit 14 stops operating, and a high-frequency voltage is applied from lighting circuit 13 to discharge lamp 1 via cap holder 8, cap 5, secondary coil 12, receive terminal 9 and terminal 6, thereby keeping discharge lamp 1 lit continuously.

If the discharge lamp 1 is disconnected from cap holder 8 of power supply 2 to, for instance, replace the lamp with a new one, core 7 of high-voltage transformer 10 will be separated from primary and secondary coils 11 and 12. This provides no electromagnetic link between primary coil 11 and secondary coil 12, thereby disabling the function of high-voltage transformer 10.

Thus, even if a high-frequency pulse signal is supplied from starting circuit 14 to primary coil 11 with discharge lamp 1 being disconnected, no high voltage will be generated in secondary coil 12; thus, no high voltage is applied to cap holder 8. This ensures the safety of the user and eliminates the need for an increase of the withstanding voltage of cap holder 8 and its peripheral section. Thus, the size of cap holder 8 and its peripheral section can be made even smaller than a conventional cap holder, and can be made of inexpensive material having a low withstanding voltage.

Moreover, as described earlier, only core 7 of the high-voltage transformer is provided in cap 5 of discharge lamp 1; thus, discharge lamp 1 can be made smaller and simpler, compared to the conventional method in which the entire high-voltage transformer is built in below the discharge lamp.

Figure 4:
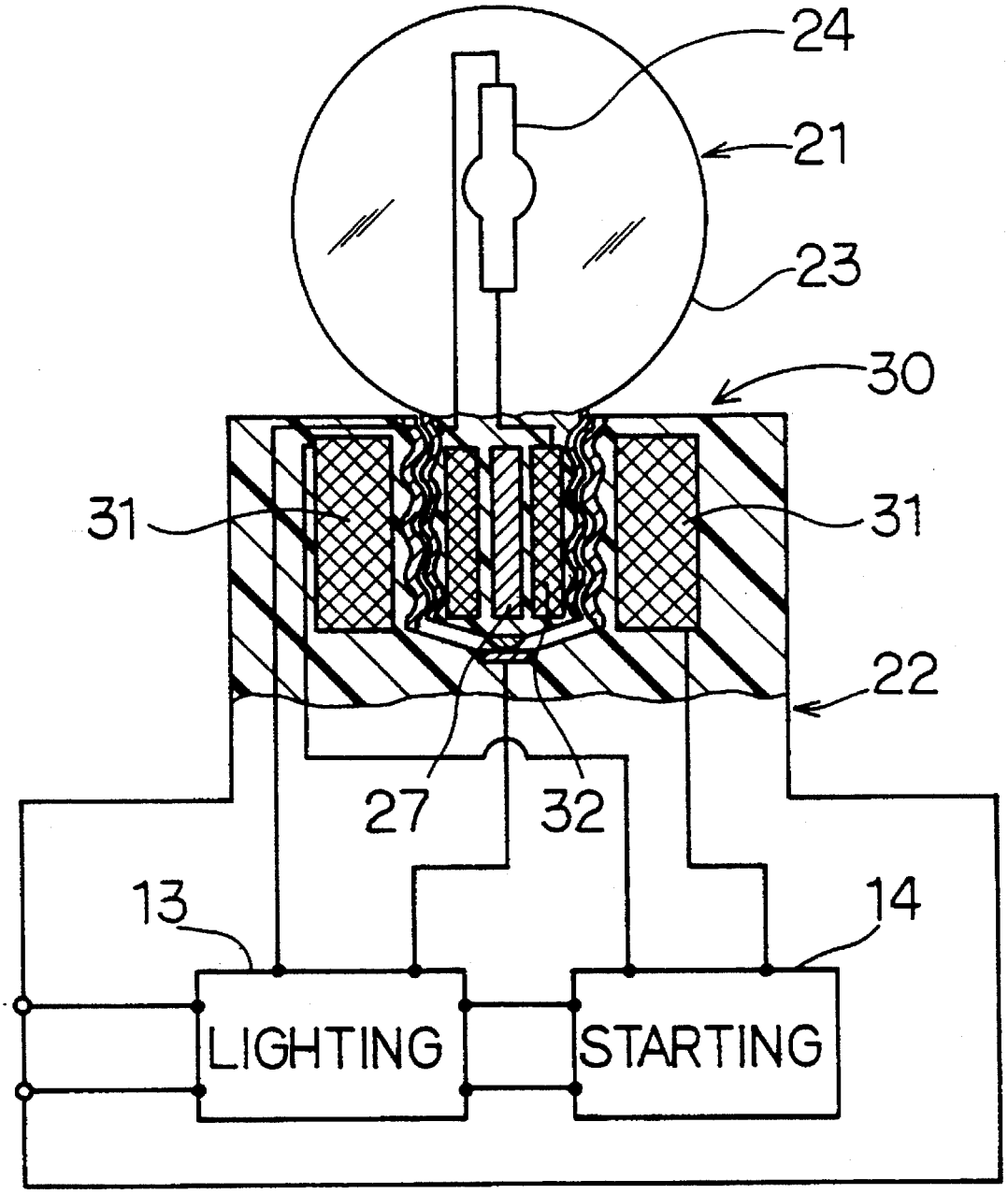
FIG. 4 is a partial cross-sectional view of a discharge lamp unit according to a second embodiment of the present invention.
Figure 5:
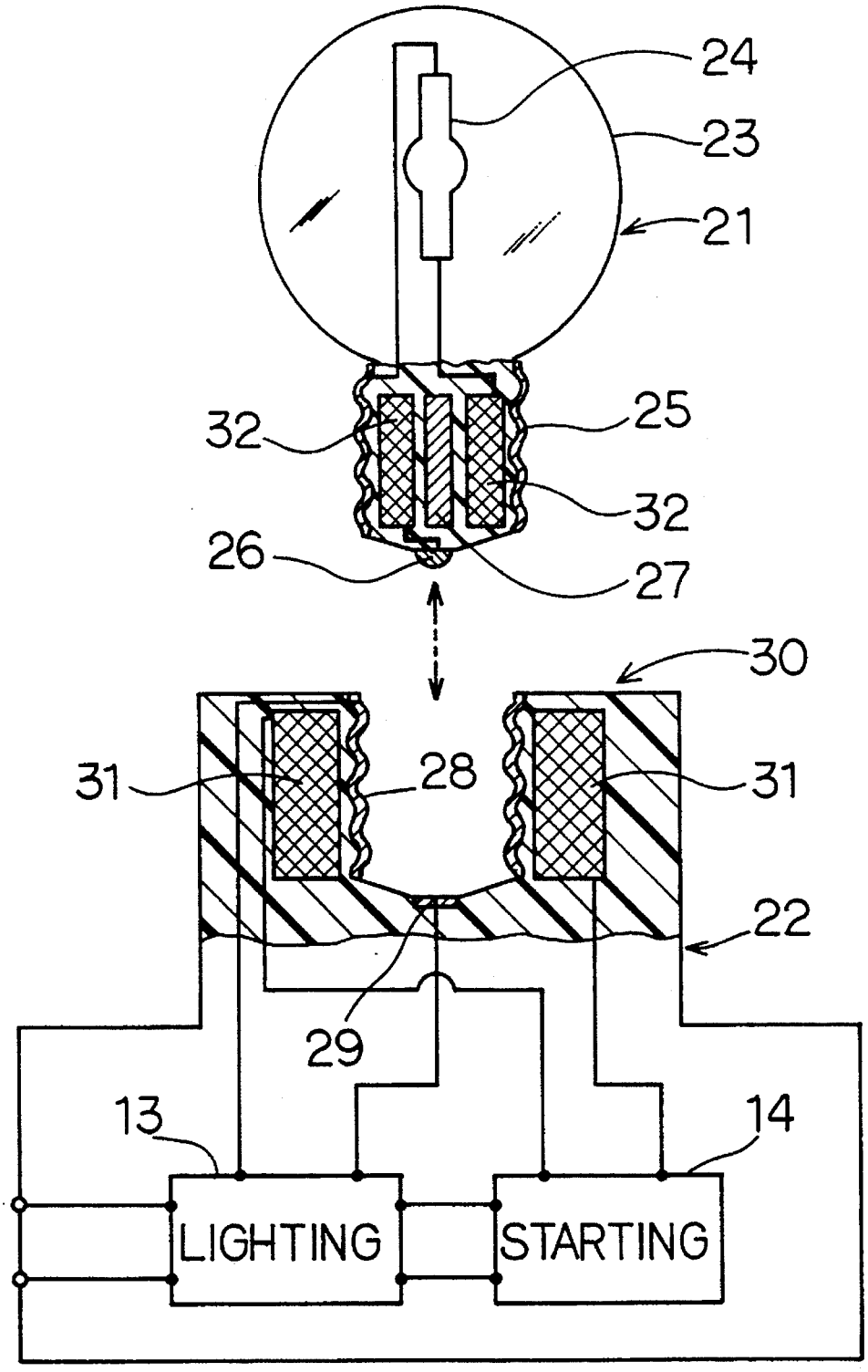
FIG. 5 is a partial cross-sectional view of the discharge lamp unit according to the second embodiment with the discharge lamp disconnected.

FIGS. 4 and 5 show a discharge lamp unit according to a second embodiment of the present invention. In this discharge lamp unit, core 27 and secondary coil 32 of high-voltage transformer 30 are provided inside cap 25 of discharge lamp 21.

In other words, discharge lamp 21 consists of flash tube 24 which is located inside glass external tube 23, cap 25 which is fixed below external tube 23, and insulated terminal 26 which is fixed below cap 25. Core 27 which forms the core section of high-voltage transformer 30 and secondary coil 32 is fixed in the middle of cap 25 with insulating material.

Core 27 is located in the middle of cap 25, and secondary coil 32 is located around core 27.

An insertion section used to mount discharge lamp 21, that is, cap holder 28 used to receive cap 25, is provided on top of discharge lamp power supply 22. Insulated receive terminal 29 is fixed beneath cap holder 28 so that terminal 26 will come into contact with receive terminal 29 when cap 25 of discharge lamp 21 is fitted to cap holder 28.

Primary coil 31 of high-voltage transformer 30 is wound around cap holder 28. Lighting circuit 13 and starting circuit 14, which are the same as those previously described, are provided inside discharge lamp power supply 22. The output side of lighting circuit 13 is connected to cap holder 28 and cap holder 29, and the output side of starting circuit 14 is connected to both ends of primary coil 31 of high-voltage transformer 30.

As previously explained, with a discharge lamp having the above structure, discharge lamp 21 is fitted in place as its cap 25 is inserted into cap holder 28 located on top of power supply 22. This provides an electrical connection between cap 25 and cap holder 28 and between terminal 28 and receive terminal 29. Core 27 and secondary coil 32 are located inside primary coil 31 of high-voltage transformer 10 to provide an electromagnetic link for both coils 31 and 32.

When lighting circuit 13 and starting circuit 14 begin to operate as the power switch is turned on, starting circuit 14 outputs a high-frequency pulse signal to primary coil 31 of high-voltage transformer 30. As a result, secondary coil 32 generates a high-frequency, high-voltage pulse which is then sent to flash tube 24 of discharge lamp 21 via terminal 26 and cap 25, thereby commencing discharge inside flash tube 24 to light up discharge lamp 21 instantly.

Once discharge has started, starting circuit 14 stops operating, and a high-frequency voltage is applied from lighting circuit 13 to the flash tube 24, thereby keeping discharge lamp 21 lit continuously.

If the discharge lamp 21 is disconnected from cap holder 28 of power supply 22, for instance, to replace the lamp with a new one, core 27 and secondary coil 32 of high-voltage transformer 30 will be separated from primary coil 31. This provides no electromagnetic link between primary coil 31 and secondary coil 32, thereby disabling the function of high-voltage transformer 30.

Thus, even if a high-frequency pulse signal is supplied from starting circuit 14 to primary coil 31 with discharge lamp 21 being disconnected, no high voltage will be generated in secondary coil 32; thus, no high voltage is applied to cap holder 28. This ensures the safety of users and eliminates the need for an increase of the withstanding voltage of cap holder 28 and its peripheral section.

With discharge lamp 21 of this embodiment, the length of the output wire of high-voltage transformer 30, that is the length of the connecting wire from secondary coil 32 to flash tube 24 of discharge lamp 21, can be made shorter than that of the previous embodiment. This gives advantages in insulation for high voltages and prevention of noise.

Furthermore, it is possible to provide only the secondary coil of the high-voltage transformer in the discharge lamp, and to provide the core, primary coil, etc. in the power supply side, which is used as the base.

To prevent induction of starting high voltage during disconnection of the discharge lamp as described above, at least core 27 of high-voltage transformer 3, that is, the magnetic path material used to provide the electromagnetic link with the transformer, and secondary coil must be put together with discharge lamp 21 into one unit. Furthermore, to reduce the number of terminals between discharge lamp 21 and power supply 22, at least primary coil 31 of high-voltage transformer 30 must be provided in power supply 22.

Although the present invention has been fully described in connection with the preferred embodiment thereof with reference to the accompanying drawings, it is to be noted that various changes and modifications will become apparent to those skilled in the art. For example, although the invention has been disclosed in connection with a lighting apparatus for home use and the like which uses, e.g., commercial AC power, it may also be used in other environments such as vehicle-mounted lighting devices utilizing vehicular DC electric power and the like. Such changes and modifications are to be understood as being included within the scope of the present invention as defined by the appended claims.

What is claimed is:

1. A discharge lamp unit comprising:

a lamp section including a lamp; and a base section to which said lamp section is mounted;

wherein a part of a high-voltage transformer for applying a high voltage to said lamp section when starting said lamp is provided in said lamp section; and wherein a remaining part of said high-voltage transformer is provided in said base section.

2. The discharge lamp unit of claim 1, wherein:

a core of said high-voltage transformer is provided in said lamp section; and a primary coil and a secondary coil of said high-voltage transformer are provided in said base section.

3. The discharge lamp unit of claim 1, wherein:

a core and secondary coil of said high-voltage transformer are provided in said lamp section; and a primary coil of said high-voltage transformer is provided in said base section.

4. The discharge lamp unit of claim 1, wherein:

a core of said high-voltage transformer is provided in a cap of said lamp section;

a primary coil of said high-voltage transformer is provided on a peripheral surface of a cap of said base section; and said cap of said lamp section is inserted in said cap of said base section to provide an electromagnetic link between said primary coil and a secondary coil of said high-voltage transformer.

5. The discharge lamp unit of claim 4, wherein said secondary coil is provided in said cap of said lamp section.

6. The discharge lamp unit of claim 4, wherein said secondary coil is provided on said peripheral surface of said cap of said base section.

7. A discharge lamp having a flash tube which is provided in an external tube and a connecting cap which is attached to an end of said external tube, wherein only a part of a high-voltage transformer for applying a high voltage to said flash tube at start of lighting is provided in said cap.

8. The discharge lamp of claim 7, wherein a part of said high-voltage transformer which is provided in said cap forms a core of said transformer.

9. The discharge lamp of claim 8, wherein a part of said high-voltage transformer which is provided in said cap forms said core and a secondary coil of said transformer.

10. A discharge lamp power supply which has a cap holder to hold a cap of a lamp section including a lamp and is for supplying power including a high voltage to said lamp section when starting said lamp, wherein a part of a high-voltage transformer which generates said high voltage is provided on a peripheral surface of said cap holder.

11. The discharge lamp power supply of claim 10, wherein a part of said high-voltage transformer forms a primary coil and a secondary coil.

12. The discharge lamp power supply of claim 10, wherein a part of said high-voltage transformer forms a primary coil.

13. A method of operating a discharge lamp unit, said method comprising the steps of:

disposing a portion of a lamp section including at least one of a primary coil, a secondary coil and a core proximate to a base section including remaining ones of said primary coil, said secondary coil and said core which are not in said lamp section to enable establishment of an electromagnetic linkage between said primary coil and said secondary coil; and disposing said lamp section away from said base unit to disable establishment of said electromagnetic linkage;

wherein said base section includes at least one of said primary coil, said secondary coil and said core.

14. The method of claim 13, wherein said proximate disposing step comprises a step of disposing a portion of a lamp section having a core proximate to a base section having primary and secondary coils.

15. The method of claim 13, wherein said proximate disposing step comprises a step of disposing a portion of a lamp section having a core and a secondary coil proximate to a base section having a primary coil.

* * * * *